United States Patent [19]

Abrahamson et al.

[11] Patent Number: 4,923,582

[45] Date of Patent: May 8, 1990

[54] MONOPOLAR, BIPOLAR AND/OR HYBRID MEMBERANE CELL

[75] Inventors: Donald W. Abrahamson, Painesville; Marilyn J. Harney, Concord; Elvin W. Vauss, Jr., Cleveland; Andrew J. Niksa, Concord; James J. Stewart, Chardon, all of Ohio

[73] Assignee: ELTECH Systems Corporation, Boca Raton, Fla.

[21] Appl. No.: 161,921

[22] Filed: Feb. 29, 1988

Related U.S. Application Data

[63] Continuation of Ser. No. 841,486, Mar. 19, 1986, Pat. No. 4,738,763, which is a continuation of Ser. No. 558,850, Dec. 7, 1983, abandoned, which is a continuation-in-part of Ser. No. 529,691, Sep. 6, 1983, abandoned, which is a continuation-in-part of Ser. No. 453,573, Dec. 27, 1982, abandoned.

[51] Int. Cl.[5] ..... C25B 9/00; C25B 11/00

[52] U.S. Cl. ..... 204/255; 204/257; 204/279; 204/290 R; 204/263; 204/290 F; 204/292; 204/293

[58] Field of Search ..... 204/98, 128, 253–258, 204/279, 284, 290 R, 282–283, 263, 290 F, 292, 293, 288, 297 R

[56] References Cited

U.S. PATENT DOCUMENTS

| | | | |
|---|---|---|---|
| 4,017,375 | 4/1977 | Pohto | 204/255 |
| 4,078,986 | 3/1978 | Smith | 204/297 R |
| 4,108,752 | 8/1978 | Pohto et al. | 204/256 |
| 4,244,802 | 1/1981 | Pohto et al. | 204/252 |
| 4,309,264 | 1/1982 | Bender et al. | 204/256 X |
| 4,315,810 | 2/1982 | Kircher | 204/257 |
| 4,343,689 | 8/1982 | de Nora et al. | 204/253 |
| 4,368,109 | 1/1983 | Ford | 204/253 |
| 4,381,984 | 5/1983 | Kircher | 204/258 |
| 4,389,289 | 6/1983 | de Nora | 204/128 |
| 4,402,810 | 9/1983 | Boulton et al. | 204/255 |
| 4,617,101 | 10/1986 | Sato et al. | 204/252 |

*Primary Examiner*—Donald R. Valentine
*Attorney, Agent, or Firm*—John J. Freer

[57] ABSTRACT

Monopolar, bipolar, and hydrid filter press electrolytic cells for electrolytic processes utilizing a novel method of introducing and removing electrical energy are disclosed. The invention contemplates a novel low pressure, high surface contact area connecting means for joining the anode element and cathode element of electrode assemblies. The invention also contemplates a low pressure, high surface contact area contact of the current distributor member to the back plate.

16 Claims, 14 Drawing Sheets

MONOPOLAR, BIPOLAR AND/OR HYBRID MEMBERANE CELL

This is a continuation of application Ser. No. 841,486, filed Mar. 19, 1986, now U.S. Pat. No. 4,738,763, which is a continuation of U.S. Ser. No. 558,850, filed Dec. 7, 1983, now abandoned, which is a continuation-in-part of U.S. Ser. No. 529,691, filed Sept. 6, 1983, now abandoned, which in turn is a continuation-in-part of U.S. Ser. No. 453,573, filed Dec. 27, 1982, now abandoned.

Many important basic chemicals which are utilized in modern society are produced by electrolysis. Nearly all of the chlorine and caustic used in the world today is produced by the electrolysis of aqueous sodium chloride (brine) solutions. There is increasing interest in the electrolysis of water, the production of oxygen and particularly, hydrogen which is finding ever increasing use in our society. Other uses of electrolysis include electro-organic synthesis, batteries and the like, and even more common applications such as water purification systems and swimming pool chlorinators.

Flowing mercury cathode cells and diaphragm cells have provided the bulk of the electrolytic production of chlorine and caustic. In more recent times, the membrane-type electrolytic cell has gained popularity because of its ease of operation and, particularly, because of its lack of polluting effluents such as from mercury or the use of carcinogenic material such as asbestos. Membrane-type electrolytic cells generally comprise an anode chamber and a cathode chamber which are de fined on their common side by a hydraulically impermeable ion-exchange membrane, several types of which are now commercially available but are generally fluorinated polymeric materials.

Membrane-type electrolysis cells generally comprise one of two distinct types, that is the monopolar-type in which the electrodes of each cell are directly connected to a source a power supply, or the bipolar-type in which adjoining cells in a cell bank have a common electrode assembly there between, said electrode assembly being cathodic on one side and anodic on the other.

However, in the past these two designs have been so different that few parts of these electrolytic cells have been interchangeable. Thus, each type of cell has required substantially completely different components for each. Further, even when components have been similar they have generally required completely separate manufacturing tools and processes.

Several designs of both monopolar and bipolar membrane cells incorporate a pair of formed metal pan structures which define the anode and cathode compartment when similar pans are assembled in a facing relationship with a membrane interposed therebetween. Cells of this type are described in U.S. Pats. Nos. 4,017,375 and 4,108,752, for example.

Because of the rigorous corrosive conditions existing in the electrolytes of both the anode and cathode chambers, it has been necessary to form the anode and cathode pan out of material which is resistant to the electrolyte. In most cases, anode pans were formed from titanium or other valve metals or their alloys in sheet form. Similarly, cathode pans were formed from ferrous metals such as steel, stainless steel, as well as metals such as nickel. An example of such pans in a monopolar cell is described in U.S. Pat. No. 4,244,802. However, a disadvantage is this patent requires expensive lamination of the highly conductive metal outer layer to the pan, which is unnecessary when pans are employed in the present invention.

In a bipolar cell the electrical connections between the anode/cathode parts of a bipolar element have provided serious de sign problems. Due to the different corrosive environments of the anode and cathode the parts are made of different materials. Electrically connecting these materials has been done in several ways, each with some inherent disadvantages. For example, the use of titanium/stud bonded plates has had the problem of hydrogen diffusing through the stud plate and hydriding the titanium and thereby destroying the bond. Trimetal (titanium/copper/steel) plates have overcome the hydriding problem, but at a cost that is extremely high. Other forms of mechanical connections have been difficult because of the requirements of internal bolts or fasteners to apply the joint pressure required to make these mechanical connections viable.

In a monopolar cell, in addition to the necessity of corrosion resistance, there is the necessity of conducting current from the external power source into, and out of, the monopolar elements and evenly distributing the current across the active electrode surfaces. In order to carry and distribute this current with low ohmic losses (especially in large area electrodes) a low resistance conductor must be used. This conductor may be made of a large cross section of the corrosion-resistant metal or of a smaller cross section of a metal such as copper or aluminum, for example, which has a specific resistance 5 to 50 times lower than the corrosion-resistant metals. Obviously, these low resistance metals must be protected from corrosion by the electrolytes in order to make them viable materials for use in electrolytic cells.

One method used in the past to help alleviate problems of getting electric current to the electrode active area while maintaining low structural voltage losses and even current distribution across the membrane in monopolar membrane electrolyzers has been to use a copper conductor bar with suitable corrosion-resistant metal bonded or clad to the copper. The disadvantages of this approach are high manufacturing costs, limited shape and size availability, difficult welding, chamber width limited by the width of the conductor bar, interference with electrolyte flow, longer current paths necessary due to conductor spacing causing uneven current distribution to the membrane, problems of sealing the cells where the conductor bars pass through the cell structure, high cost dictating a higher current density and therefore high structural IR losses and the requirement of removal of conductor bars before electrodes can be recoated. (IR is an abbreviation from the Ohm's Law equation, $V=IR$, which means voltage equals current multiplied by resistance. Thus, by IR, we intend voltage.)

A second approach Which has been used in the past is to eliminate the copper and carry the current in the corrosion-resistant metal electrode structure. Since the electrical resistance of the corrosion resistant metal (e.g., titanium, nickel, stainless steel) is high compared to copper and aluminum, the voltage loss is increased and the length of the current path must be kept as short as possible (i.e., small electrode dimension parallel to the current path). This then limits the size of an electrode active area, increases the sealing perimeter to active area ratio, and requires many smaller components to create the same total active area. Thus, a larger active area to sealing perimeter would also provide the additional benefit of a more efficient use of the membrane area (i.e., active area/purchased area ratio is higher). Current distribution in connection to external buswork is also difficult with this approach.

Therefore, the advantages of this invention are to reduce the ohmic loss in monopolar or bipolar electrolyzer structures, by reducing the electrical resistance due to structural cOmponents and mechanical connection problems, to improve current distribution, to allow for greater electrode active areas and to decrease the sealing perimeter to active area ratio.

In one aspect, these advantages are enhanced in the bipolar membrane-type cell by using novel low pressure, high surface contact area, low current density mechanical connections between the back plates of the anode and cathode elements of a bipolar electrode assembly. In another aspect of the instant invention, a similar novel low pressure, high surface area contact between the back plates of the cells in the assemblies of a hybrid electrolyzer combination of monopolar and/or bipolar cells is utilized.

This invention also provides a structure for membrane cells which requires little or no retrofitting. As newer and better electrode elements are developed they may be retrofit without loss of the novel current distributor member and/or the novel monopolar, bipolar, or hybrid cell to cell low pressure contact feature.

This invention also contemplates a cathode design, anode design, and current distributor member design which are usable for both bipolar and monopolar membrane cell arrangements without modification allowing a single production of items to be used in both types of electrolyzers by simply changing the assembly sequence. (Because of this unique ability another electrolyzer configuration is contemplated which is a hybrid or combination monopolar, and/or bipolar arrangement of cells within one electrolyzer. The hybrid electrolyzer then may comprise a number of monopolar sections electrically arranged in a series (i.e. bipolar) fashion or a number of bipolar sections electrically arranged in parallel (i.e. monopolar) fashion or any combination of bipolar and monopolar. The advantages are ability to select electrolyzer current to match a convenient or existing rectifier capacity, avoid the shortcomings of bipolar design (such as current leakage, single current path through electrolyzer, high voltage circuits), avoid the shortcomings of monopolar design (reduction in amount of buswork required, lower current circuits). Other advantages and configurations of a hybrid design will be readily apparent to those skilled in the art.

Additional advantages of the invention include the ability to change current distributor members without changing other components, the ability to change cell elements without changing other components, the ability to allow for current density changes optimizing power cost versus capital costs, and the ability to obviate any need for conductor bars.

Therefore, the present invention provides for a filter press electrolyzer comprising at least one electrolytic cell for electrolytic processes; said electrolyzer being provide d with end plates which form end walls for said electrolyzer; said cell having vertically disposed electrode assemblies and at least one membrane positioned therein; said cell including means for introducing and removing liquids, gases and electrical energy; said electrode assemblies having back plates of electrically conductive material which is corrosion resistant to the internal cell conditions and through which current is introduced into and removed from the electrodes; the improvement comprising an electrical connectiOn between an opposing electrode assembly back plate and a current supply means via a contact joint wherein the dimensions of electrical contact area are substantially the same as the dimensions of said electrode assemblies of said cell, and said contact joint comprises a low pressure, high surface contact area, low current density mechanical connection without metallurgical bonding, and wherein said current supply means is selected from an anode back plate, a cathode back plate, a current distributor member, or combinations thereof, whereby said electrical contact joint is separated from the electrolyte via the opposing back plate.

The present invention also provides for use of the electrolyzer in the above paragraph to produce caustic and halogen from brine.

The present invention also provides for a process for the production of caustic and halogen from brine comprising the steps of (1) placing brine in intimate contact with a filter press electrolyzer comprising at least one electrolytic cell for electrolytic processes; said electrolyzer being provided with end plates which form end walls for said electrolyzer; said cell having vertically disposed electrode assemblies and at least one membrane positioned therein; said cell including means for introducing and removing liquids, gases and electrical energy; said electrode assemblies having back plates of electrically conductive material which is corrosion resistant to the internal cell conditions and through which current is introduced into and removed from the electrodes; and (2) introducing electrical energy into said cell thereby producing caustic and halogen; the improvement in said process comprising an electrical connection between an opposing electrode assembly back plate and a current supply means via a contact joint wherein the dimensions of electrical contact area are substantially the same as the dimensions of said electrode assemblies of said cell, and said contact joint comprises a low pressure, high surface contact area, low current density mechanical connection without metallurgical bonding, and wherein said current supply means is selected from an anode back plate, a cathode back plate, a current distributor member, or combinations thereof, whereby said electrical contact joint is separated from the electrolyte via the opposing back plate.

The current supply means referred to in the paragraphs above may be an anode back plate, may be a cathode back plate, or may be a current distributor member.

Figure 1:
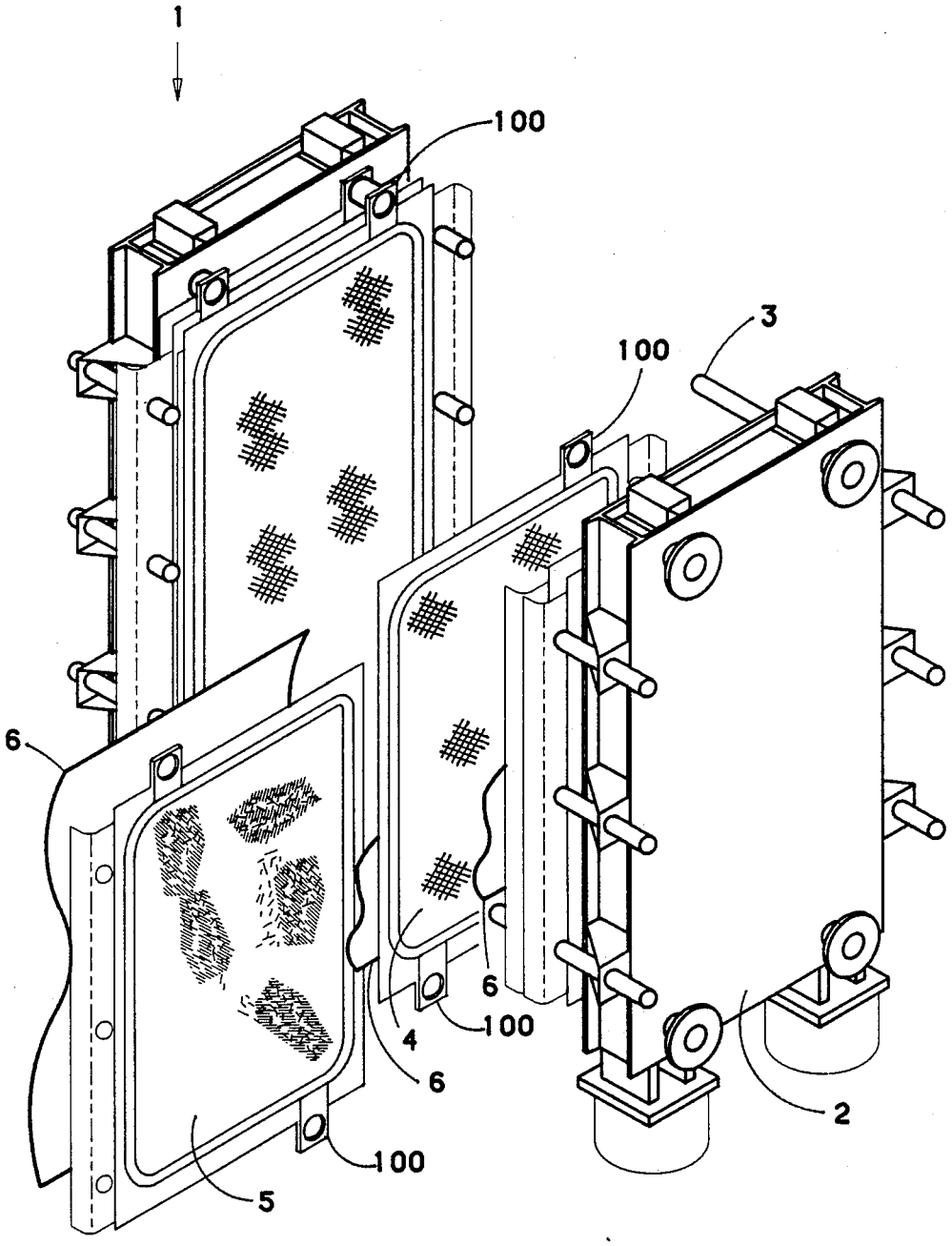
FIG. 1 is an exploded view of a monopolar filter press electrolytic cell of the invention.

The present invention relates to an electrolyzer having a monopolar filter press electrolytic cell for use in electrolytic processes. Cells of this type generally cOntain anodes, cathodes, membranes and are contained within bulkheads connected by tie rods which may or may not be spring loaded. The monopolar embodiment of the present invention contemplates having current distributor members situated between adjacent cathodes and between adjacent anodes thereby allowing current to be brought into and removed from said anodes and cathodes within said cells via the novel low pressure, low current density, high area connection of the present invention.

The present invention also relates to an electrolyzer having a bipolar filter press electrolytic cell for use in electrolytic processes. Cells of this type generally contain bipolar electrode assemblies, and membranes, and are contained within bulkheads connected by tie rods which may or may not be spring loaded. In one embodiment, the bipolar embodiment of the present invention contemplates the pre sent, novel current distributor member situated between each end plate and a bipolar electrode assembly, with an anode side facing one end plate and a cathode side facing the other end plate, thereby allowing current to be brought into and removed from said cells via the novel low pressure, low current density, high area connection of the present invention. Further, conducting electrical current from cell to cell is accomplished via a novel low pressure, high surface contact area, low current density mechanical connections between the back plates of the anode and cathode elements of the bipolar electrode assemblies.

Also, the present invention relates to an electrolyzer having a hybrid combination monopolar and/or bipolar cells arranged within one electrolyzer for use in electrolytic processes. Electrolyzers of this type may be made up of a number of bipolar sections arranged in a monopolar fashion, that is each bipolar section electrically connected in parallel within the end walls of one electrolyzer; or it may be made up of a number of monopolar sections arranged in a bipolar fashion, that is each monopolar section electrically connected in series within the end walls of one electrolyzer; the electrical connections to the electrodes being made using the novel low pressure high area, connection between either a current distributor member of the back plate of another electrode. Also, the hybrid embodiment of the present invention contemplates any arrangement of monopolar and/or bipolar assemblies within one electrolyzer. The hybrid embodiment contemplates use of the novel low pressure, high area, low current density connection, with the contact area for said connection substantially the same dimensions of the active area of said electrodes.

For the monopolar, bipolar, and hybrid embodiments also, there is provided a method of sealing the system so as to prevent leakage of feedstocks and products produced in said cell as well as there is provided a means, either external or integral, of receiving raw materials and removing resulting products. Also provided is a method of introducing and removing electrical energy into and out of the cells. This electrical system is generally referred to as a bus system and in the present invention is external to the cells.

Anodes suitable for use in the instant invention comprise an anode back plate and an active anode surface area.

In a preferred embodiment, the active anode surface area comprises a foraminous anode of a type which is generally known in the art comprising valve metal substrate having an electrocatalytic coating applied thereto of precious metals and/or oxides thereof, transition metal oxides and mixtures of any of these materials. The anode member is generally planar in form and may be constructed of any foraminous material such as expanded metal mesh, perforated plate or wire screening. It is to be understood that this foraminous material has a high surface area and large number of points of contact with the membrane brought about by having a large number of small perforations, for example: expanded metal mesh having what is commonly known as having "micromesh size" pores. Also suitable is a reticulated anode of titanium metal coated with DSA$^{RTM}$ (an electrocatalytic coating) such as is described in U.S. Pat. application Ser. No. 396,747, filed Jul. 9, 1982 now abandoned in favor of U.S. Pat. application Ser. No. 509,731, issuing as U.S. Pat. No. 4,517,069, in the name of Harney et al and which is hereby incorporated by reference This active anode area is mechanically and electrically attached to the anode back plate preferably by welding. Further, preferably, the active anode area is attached to the back plate via springs. Thus, the anode may be spring loaded against the membrane to help provide a large number of points of contact. These springs may take many forms and be of various metals, preferably the same metal as used to form the active anode area. The welding may take the form of resistance welding, TIG welding (tungsten inert gas welding), electron beam welding, diffusion welding (diffusion bonding) and laser welding for example. Presently preferred at this time is the technique of resistance welding.

It is to be understood, however, that in using a reticulated anode the active reticulate material may be cast in place and diffusion bonded into the pan or may be welded by any of the above suitable welding techniques.

Cathodes suitable for use in the present invention may be generally described as comprising a cathode back plate and an active cathode surface area. In a preferred embodiment the present invention contemplates a cathode pan preferably stamped from a planar sheet of nickel, iron, steel, stainless steel, or other similar alloy material. The active cathode surface area is likewise made of a material such as iron, steel, stainless steel, or other similar alloy material. The cathode active surface area is foraminous in nature and preferably is a reticulate metal member formed as described, i.e. in Application Serial No. 386,934, filed Jun. 10, 1982 now abandoned in favor of U.S. Pat. Application Ser. No. 741,491, issuing as U.S. Pat. No. 4,615,784, in the name of Stewart et al, Which is herein incorporated by reference. It is understood, however, that nickel mesh, steel mesh, etc., and spring loaded systems similar to those describe d hereinabove in relation to anodes are also suitable. Also, other known types of cathodes for use in zero gap and/or finite gap cells are suitable for use in the current invention.

The cathode active surface area is electrically, and mechanically attached to the cathode pans. In the case of the cathodes being fabricated from metal mesh analogous to the mesh anodes described hereinabove welding is the preferred method of attachment. In the case of fabricating the reticulated cathodes the preferred method of attachment is plating, most preferably galvanic plating. This contact can be realized solely by mechanical pressure if so desired.

Finally, while the anodes and cathodes have been described in their relationship to the preferred embodiment of the instant invention, namely a membrane gap cell (zero gap cell), it is to be clearly understood that whether or not the cell has a finite gap between membrane and electrode or not is not critical to the present invention. Thus, the present invention is also completely suitable for use in finite gap cells which are well known and understood in the art and therefore will not be further described herein.

In the preferred embodiment, the electrodes of the present invention utilize pans with a single back plate configuration. Thus pans for the anodes and pans for the cathodes are both formed on similar dies and are substantially identical in size and shape. The differences in them being: the manifolding arrangement used which allows the proper fluids to enter and exit the particular area, i.e., cathode area or anode area, and the materials of the pans; the anode pan generally being made of a valve metal preferably titanium or a titanium alloy or other metal resistant to corrosive conditions of the anode chamber, and the cathode pan being made of nickel, steel, stainless steel or alloys thereof or other metals resistant to corrosive conditions of the cathode chamber; the location of the sealing means or groove to contain the sealing means.

The pans are formed to create an integral frame attached to the back plate which forms a chamber for containing electrolytes and electrode active areas. The back plate is generally planar and preferably flexible to allow it to conform to a current distributor member or another electrode back plate to provide a good electrical connection. The frame of the pan may contain an area which may be rigidified by applying a grouting or filler material and also contain a face area which may be sealed by flat gaskets, 0-rings or other gasket shapes when pans are arranged in a facing relation with a membrane therebetween.

One purpose of rigidifying the pans with a grout or filler material is to provide a reinforcement of thin pan metal enabling it to withstand a compressive gasket force without collapse thus allowing economic use of the expensive corrosion resistant metals through the use of thin material, i.e., on the order of 0.015 to 0.10 inch (0.038 to 0.254 cm) thick sheet metal. Other purposes include making handling of the electrodes easier and increasing the internal pressure holding capacity.

Suitable for use as grouting or filler materials are, for example, thermoplastics, elastomers, resins, urethanes, formed metal shapes, and various polyfluorinated materials. Presently preferred are epoxy group and fiberglass reinforced polyester or vinyl esters. The grout or filler materials may be "cast in place" or prefabricated and subsequently placed and/or bonded in place. In either case, it is advantageous to be able to remove these materials relatively easily for electrode recoating processes.

In a preferred embodiment, the instant invention contemplates anode pans generally of a valve metal sheet stamped into the form of a pan. The preferable anode material is titanium metal or an alloy thereof. The anode active surface area is electrically and physically attached to the anode pan.

The present invention also contemplates that the electrode enclosure may be a frame which forms the chamber to contain the electrolytes and the electrodes, and the frame may be detachable from the back plate in lieu of being permanently attached to the back plate. The frame may be of alternate materials, such as plastic, metals, etcetera. The perimeter frame is a separate member which is gasketed to the electrode structure as opposed to the pan. Both anode and cathode elements are completed by a frame to create an enclosure for the electrolytes surrounding the electrodes and provide means of feed and discharge through passages in the frame. The frame is gasketed to the corrosion resistant plate around its perimeter and also gasketed on the opposite side which will seal to the membrane, thus creating the electrode enclosure. Anode and cathode elements are alternately stacked with membranes between and compressed by end plates (bulkheads) and tie rods. The frames may be (1) molded of any suitable corrosion resistant plastic (anode: kynar, CPVC, teflons, elastomers, ABS, etc., cathode: CPVC, polypropylene, ABS, elastomers, teflons, etc.) or (2) fabricated by welding, gluing, etc. of these plastic materials, or (3) fabricated of solid or tube - hollow - corrosion resistant metals (anode: titanium or alloys, cathode: steel, nickel, stainless steel, etc.) fabrication being by pressing, drawing, roll forming, welding, extruding, forging, etc. or a combination. The gasketing may be "0" rings, flat gaskets, extruded gaskets or other well known means (U.S. Pat. No. 4,344,633).

Membranes suitable for use in the instant invention are of several types which now are commercially available but are generally fluorinated polymeric materials which have surface modifications necessary to perform the ion-exchange function. One presently preferred material is a perfluorinated copolymer having pendent cation exchange functional groups. These perfluorocarbons are a copolymer of at least two monomers with one monomer being selected from a group including vinyl fluoride, hexafluoropropylene, vinylidene fluoride, trifluoroethylene, chlorotrifluoroethylene, perfluoro(alkylvinyl ether), tetrafluoroethylene and mixtures thereof.

The second monomer often is selected from a group of monomers usually containing an $SO_2F$ or sulfonyl fluoride pendant group. Examples of such second monomers can be generically represented by the formula $CF_2=CFR_1SO_2F$. R1 in the generic formula is a bifunctional perfluorinated radical comprising generally 1 to 8 carbon atoms but upon occasion as many as 25. One restraint upon the generic formula is a general requirement for the presence of at least one fluorine atom on the carbon atom adjacent the $-SO_2F$ group, particularly where the functional group exists as the—(—$SO_2NH)mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons, generally are available commercially such as through E.I. duPont, their products being known generally under the trademark NAFION*RTM*. Perfluorocarbon copolymers containing perfluoro (3,6-dioxa-4-methyl-7-octene sulfonyl fluoride) comonomer have found particular acceptance in $Cl_2$ cells. Where sodium chloride brine is utilized for making chloralkali products from an electrochemical cell, it has been found advantageous to employ membranes having their preponderant bulk comprised of perfluorocarbon copolymer having pendant sulfonyl fluoride derived functional groups, and a relatively thin layer of perfluorocarbon copolymer having carbonyl fluoride derived functional groups adjacent one membrane surface. It is presently preferred to have these membranes further modified with inorganic surface treatments which impregnate the surface of said membranes with metallic materials such as, i.e. $ZrO_2$, and $TiO_2$. This modification is believed to help prevent the problem of gas bubble buildup along the membrane electrode interface. By removing this problem the cell is able to operate more efficiently. A more detailed description of this type of membrane modification can be found in U.S. Pat. Application S.N. 277,918, filed Oct. 22, 1982, issuing as U.S. Pat. No. 4,421,579 in the name of Covitch et. al. and incorporated herein by reference.

The present invention utilizes a novel current distributor member for introducing current into or removing it from the cells. It is used in monopolar cells, or in bipolar cells at the connections to the external power source, or in hybrid cells to connect to external power sources or other sections of the electrolyzer. This results in the ability evenly and with lower IR losses to introduce and to distribute current into and out of the cell without the constriction of cell size due to the IR loss of the anodes and cathodes. This is possible by utilizing current distributor members having dimensions of electrical contact that are substantially the same as the dimensions of the electrode assemblies. It is possible, of course, to utilize current distributor members which are smaller dimensionally than the electrode assemblies With the clear understanding that as the size of the current distributor member is reduced the IR losses will increase. Obviously, there be point at which the IR losses become too great to be acceptable. Likewise, it is clear that the current distributor members may be dimensionally greater in size than the electrode assemblies. However, since this would not increase the contact area it would provide no advantage. By "dimensionally" is meant the dimensions of length and width which determine the surface area available for mechanical and electrical contact with the electrode assemblies. Since copper and aluminum are far better conductors of current than valve metals, certain stainless steel alloys cells may be greater in size while maintaining an acceptably low IR loss level. It is to be understood, however, that while copper and aluminum are preferred because of the weight and cost savings and lower volume of metal needed, any conductive metal will work if enough volume is provided to carry the necessary current with acceptable IR losses. In addition, this novel current distributor member allows for higher current densities to be used within the cell and therefore allows for greater caustic and chlorine production from a cell that must be run at a lower current density per unit area.

The current distributor member is generally a solid copper planar sheet but may also be any suitable conductor having sufficient cross sectional area to carry the required current with low IR loss and good current distribution. Suitable examples of these other conductive metals include, for example, nickel, iron, steel, as well as alloys of these metals and alloys of copper and aluminum.

In the preferred embodiment in monopolar cells and the monopolar cell assemblies in hybrid cell systems the current distributor members are placed between anode pans with the back side of each pan facing the current distributor member to form a single monopolar anode element. Likewise, current distributor members are placed between cathode pans with the back side of each pan facing the current distributor member to form a single monopolar cathode element.

In the preferred embodiment in bipolar cells and in the bipolar sections of the current distribution system of hybrid cells there is a current distributor member between each cell back plate and a bipolar electrode assembly, an anode side facing one back plate and a cathode side facing the other back plate. The current distributor members protrude past the side of the cell on one side only. The members between adjacent anodes extend on one side while the members between adjacent cathodes extend on the opposite side. This extension is then used to connect via a bus system, to the power source or other sections of the electrolyzer. The manner of connecting the buswork to the current distributor members is not critical and methods are well known in the art and therefore will not be further discussed herein.

In addition to being the preferred planar sheets, said current distributor members may also be sheets having calendered, dimpled, corrugated or serrated surfaces or having an interface material attached to, or inserted between, said surfaces as well as having conductive compounds, i.e., greases containing particles of conductive metals distributed therein on its surfaces. The reason for these surface modifications, if used, is to help improve the electrical contact between the current distributor members and the anodes and/or cathodes by ensuring that the highest amount of mechanical surface contact is maintained and contact resistance is minimized between said current members and said anodes or cathodes. Further, it is contemplated that the thickness of the current distributor members may vary across the length of the member based on the current and voltage requirements, to reduce cost, for the particular sized cell. It is understood that if such tapered members are used that the taper of the anodes and the taper of the cathode members between the cathodes are reversed so as to provide a parallel stack of cells to be compressed between the bulkheads. Finally, the current distributor member may also be used to provide structural support for the cell.

With respect to monopolar, bipolar, or hybrid, the current distributor member or electrode back plate is held in mechanical contact with an electrode back plate over a substantial portion of the total area, by hydraulic or static pressure of the electrolytes in the pans, by the spring pressure of the anode and/or cathode structures and by supports being compressed in the filter press arrangement by the bulkhead-tie rod assemblies. The novel electrical connection is made outside the cell so that it is separated from the electrolyte via the back plate. The back plate restrains the electrolyte so that the electrolyte does not contact the novel electrical connection. The pressure applied is in the range of from about 0.5 to 100 psi, (0.035 to 7.03 kg/cm$^2$), preferably in the range of from about 1 to 20 psi(0.0703 to 1.403 kg/cm$^2$) Increased pressure reduces contact resistance. Normally for generally known mechanical connection of electrical joints (i.e., bus work) in the art a low area, high pressure (i.e., 500–5000 psi) (35.15 to 351.5 kg/cm$^2$) joint is used to get a low specific joint resistance and current densities across the joint are high (i.e., 200–2000 asi) (31–310 amps,/cm$^2$) with the joint contact voltage loss equal to the product of specific resistance times current density. Also, other factors such as "current stream-line" effects enter into the total voltage loss across this type of mechanical joint. In the case of the contact of the current distributor to the back plate or contact of the back plate to the back plate of the present invention, the joint pressure is lower (1–20 psi) (0.0703 to 1.403 kg/cm$^2$) yielding a higher specific resistance, but the joint area is very large yielding a low current density (i.e., 0.5 to 10 asi) (0.0775 to 1.55 amps/cm$^2$) and thus a low ohmic loss across the joint. For example, a copper to titanium joint, as might be used on the anode, operating at 3 asi (0.465 amps/cm$^2$) with a pressure of 5 psi (0.3515 kg/cm$^2$) (specific resistance of $3.5\times10^{-3}$ ohm-in$^2$) ($22.58\times10^{-3}$ ohms/cm$^2$) would have a voltage loss of $1.05\times10^{-2}$ volts, and a copper to nickel joint, as might be used on the cathode, operating at 3 asi (0.465 amps/cm$^2$) with a pressure of 5 psi (0.3515 kg/cm$^2$) (specific resistance $7.7\times10^{-5}$ ohm-in$^2$) ($49.68\times10^{-5}$ ohms/cm$^2$) would have a voltage loss of $2.33\times10^{-4}$ volts. The difference between the copper to titanium and the copper to nickel is due to differences in contact resistance due to different materials and different surface preparations, oxides, etc. Modifications to the metal surfaces or the use of interface mate rials to take advantage of lower contact resistance of various metals is further discussed hereinbelow.

A thin pan is preferred because it is flexible and conforms to the current distributor member or the mating back pan in a connection creating a large contact area. Additionally, materials such as conductive reticulates (sponge metal), Multilam, conductive wools and the like may be used as an interface in contact with the current distributor member or back plates to increase the contact area. Because contact resistance is also dependent upon the materials in contact, the distributor member and/or the pan may be coated with a material as an interface to make the contact resistance lower. Suitable examples include, for example, coatings and plating of metals such as silver, gold, platinum, nickel and copper by methods such as, for example, plasma spraying, painting, flame spraying, sputtering, vapor deposition and combinations of the above.

In addition to the above materials, sealing means such as a gasket may be placed between the distributor member and pan or frame, or between anode and cathode elements of bipolar electrode assemblies. This sealing means is located so as to be around the current distributor member and/or anode element and cathode element perimeter to prevent entrance of corrosive elements which can oxidize the contact and thereby increase resistance and may also employ a conductive and/or anti-oxidation material.

The key to the success of the use of these connections is the fact that the low current densities required, i.e., approximately 0.5 to 10 asi (0.0775 to 1.55 amps/cm$^2$), with pressures at the joint of approximately less than 1 to about 100 psi (0.0703 to 7.03 kg/cm$^2$) results in low IR losses at a high resistance junction (joint).

The bulkheads, tie rods and associated equipment used to hold the cells in place and seal the cells are those generally well known in the art. They are sized to be generally the same size as the cells to be pressed between said bulkheads and generally are constructed of heavy gauge steel. The bulkheads and tie rods may or may not be electrically isolated from the cells as is preferable in each particular use. Since these types of materials are well known and understood in the art further description will not be given herein.

Introduction of brine, caustic, water and removal of hydrogen, chlorine, caustic, anolyte and catholyte may be accomplished either by internal, integral, or external manifolding. In the case where external manifolding is utilized suitable materials for carrying the various fluids and gases are well known in the art and will not be further described herein. In the case of internal or integral manifolding, the inlets and outlets may be constructed of materials that are normally attacked by the chemicals under the conditions of use but which are lined with plastics or organic polymeric materials Which are inert under the conditions of practice. Preferably, however, the integral manifolding is constructed of titanium metal or nickel metal as the case warrants for particular inputs and outputs, inlets and outlets, and said integral and/or internal manifolding is electrically isolated from the individual cells preferably by being physically spaced so as not to be in contact with the cells of polarity not desired in that particular manifold line.

The bipolar filter press zero gap electrolytic cells of the present invention, for example, are preferably configured such that an anode element pan back faces a cathode element pan back; on either exposed active surface face of said anode elements and said cathode elements is a membrane which is in physical contact with said exposed active surfaces and then on either side of the exposed surfaces of said membranes are opposite polarity active surface areas. This stack assembly is repeated until the desired number of cells is reached and then a single current distributor member is placed at each end.

The monopolar filter press zero gap electrolytic cells of the present invention are preferably configured such that two anode pan backs face each other and are separated by a current distributor member. On either exposed active surface face of said anodes is a membrane which is in physical contact with said anodes and then on either side of the exposed surfaces of said membranes are cathodes in pairs back to back with current distributor members in between each pair, This stack assembly is repeated until the desired number of cells is reached. Bulkheads are provided for either the monopolar or bipolar cell on either end with connecting tie rods and associated paraphernalia to contain said so produced cells. It is to be understood that sealing of said stack is provided by either gaskets or 0-rings, both of which are known and conventional in the art. It is further understood that the appropriate face or channeling necessary for gaskets and/or 0-rings are provided in the respective anode and cathode pans.

The present invention is more fully described by reference to the appended drawings and the discussion hereinbelow.

Figure 2:
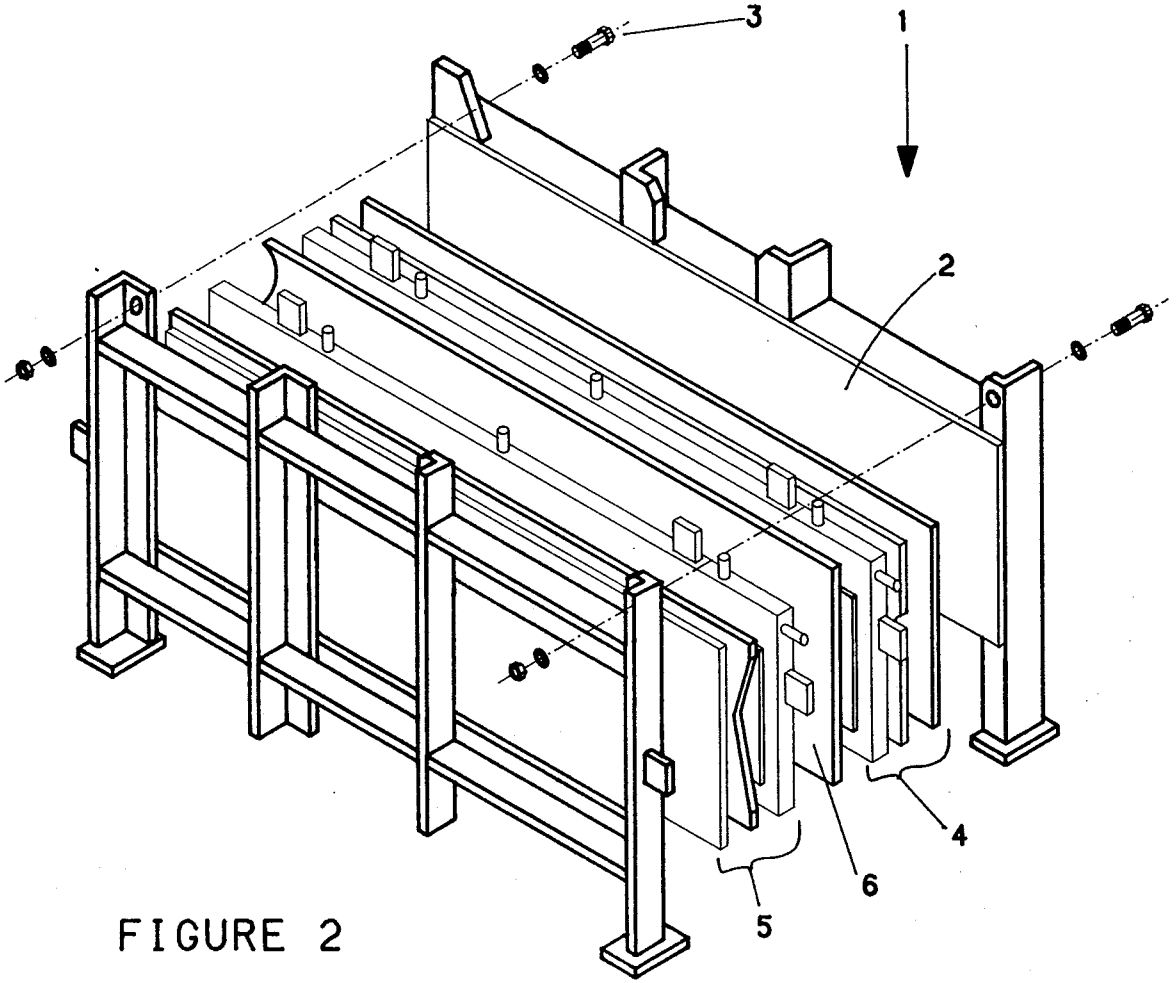
FIG. 2 is an exploded view of a cell.
Figure 3:
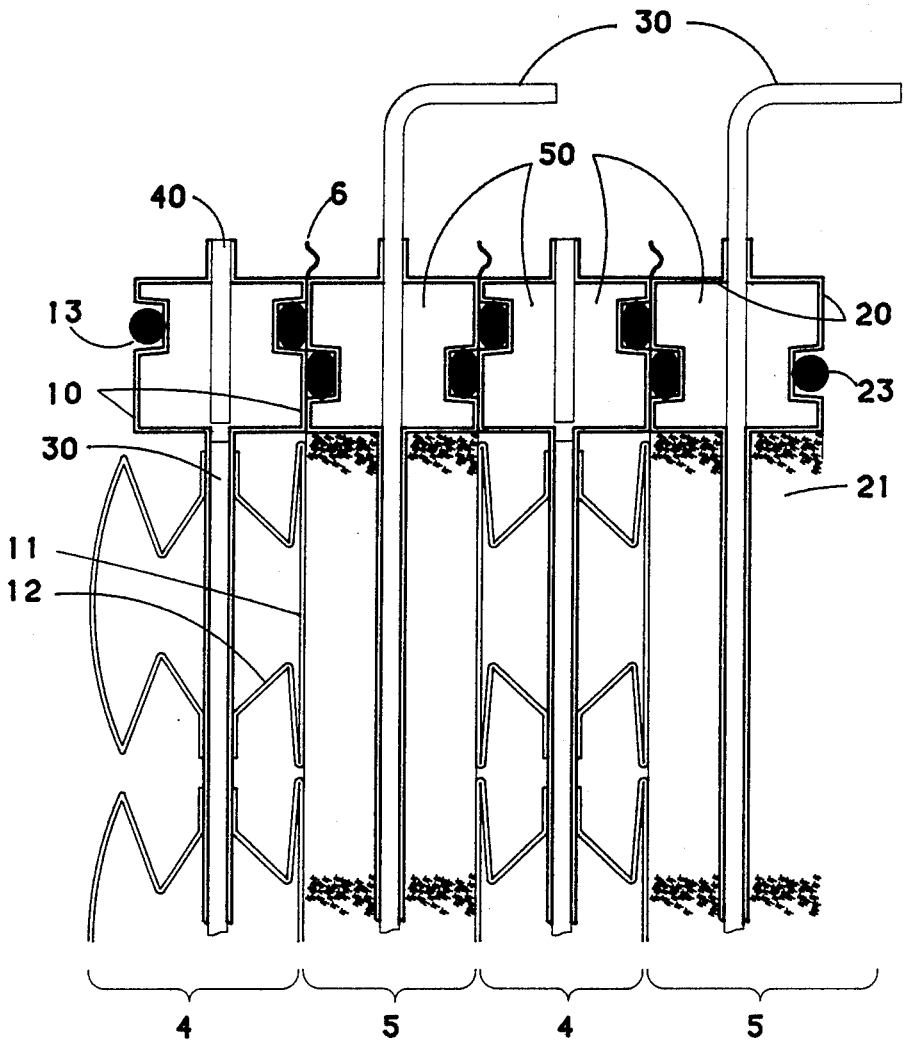
FIG. 3 is a plan view partial cross section of the monopolar filter press electrolytic cell of the invention.
Figure 4:
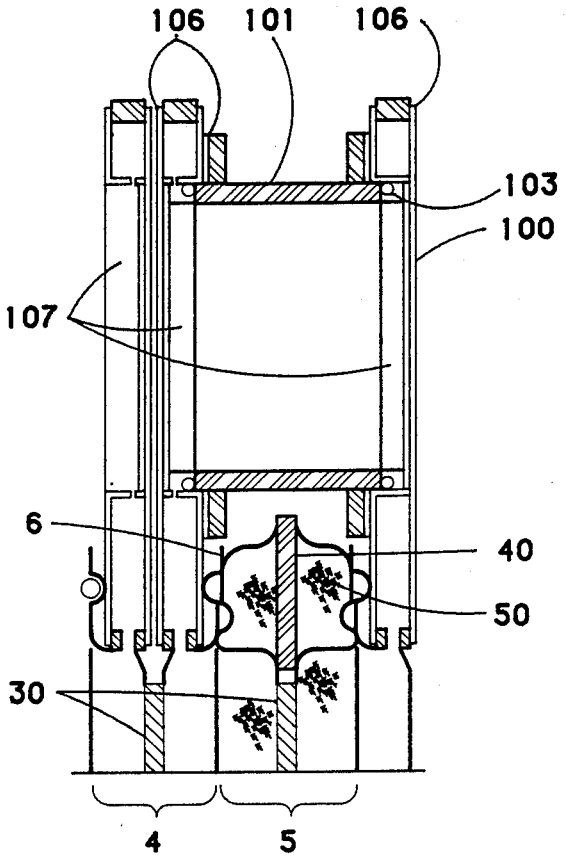
FIG. 4 is a cross sectional view of an integral manifold.
Figure 5:
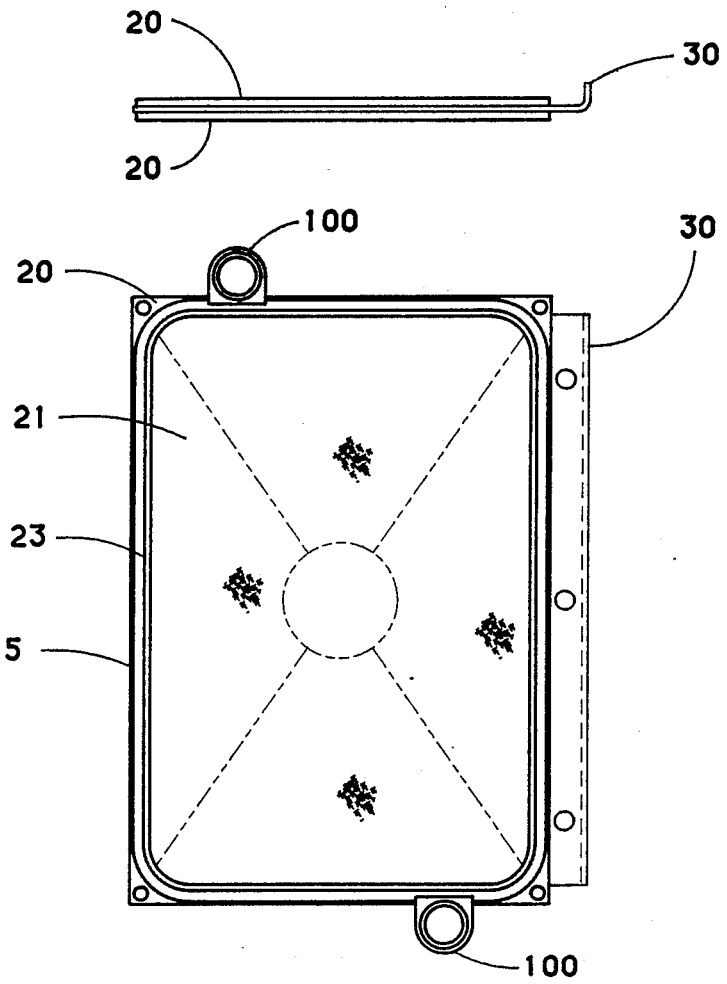
FIG. 5 is a graphic view of a monopolar cathode assembly.
Figure 6:
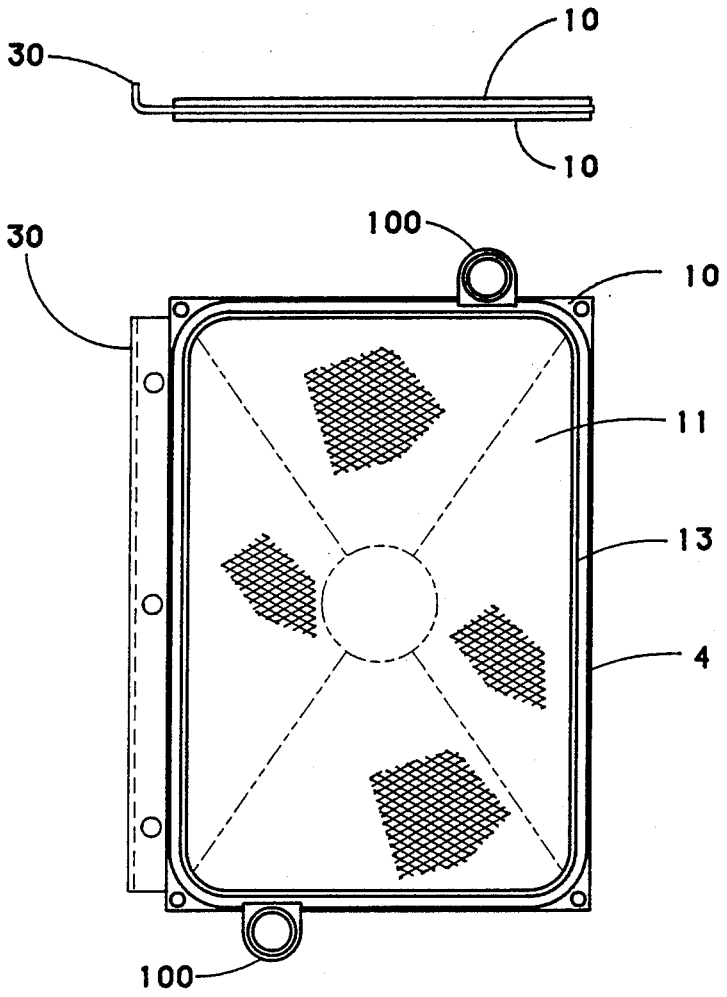
FIG. 6 is a graphic view of a monopolar anode assembly.
Figure 7:
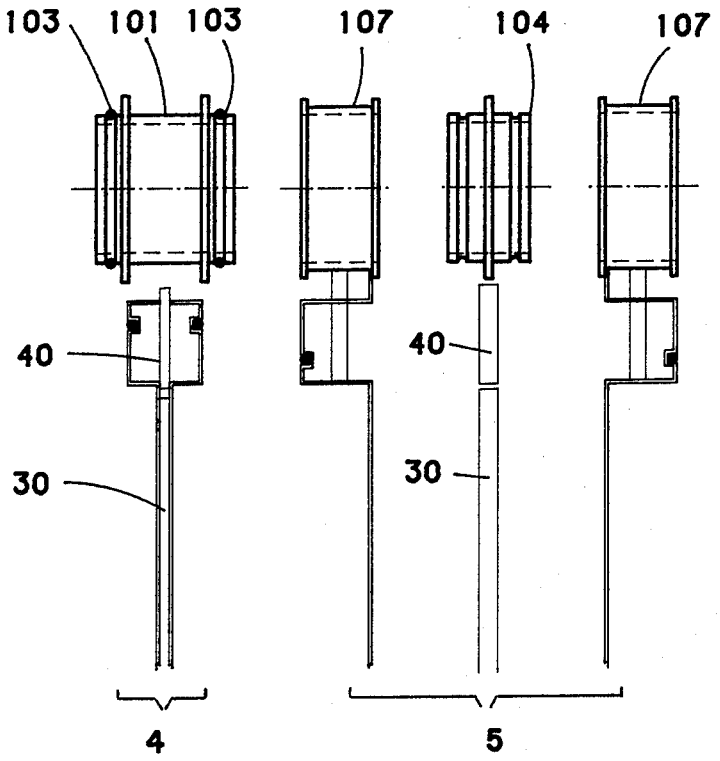
FIG. 7 is an exploded partial cross sectional view of one integral manifolding assembly of the invention.

FIGS. 1, and 3–7 relate to the monopolar embodiment of the present invention. FIG. 1 shows a preferred embodiment of the present invention as it relates to a monopolar cell configuration. FIG. 1 shows an assembly (1) consisting of a plurality of vertically disposed anode assemblies (4) and cathode assemblies (5) in physical contact with the permselective membranes (6) (zero gap). Also shown are integral discharge and inlet ports (100). Additionally bulkheads (2) and tie rods (3) are illustrated. FIG. 2 shows an exploded view of a filter press cell, as used in Example 1 and Example 2. As in FIG. 1 the cell (1) comprises bulkheads (2), tie rods (3), anode assembly (4), cathode assembly (5) and membrane (6). FIG. 3 shows a partial cross sectional plan view of FIG. 1. This view shows anode pans (10) located on either side of current distributor member (30). Likewise cathodes pans (20) are located on either side of current distributor members (30). The anode pans have active anode areas (11) attached to said pans via springs (12) and also incorporate a sealing means (13). Similarly the cathode pans (20) have active cathode areas (21) attached to them, in this particular case reticulate without springs, and also utilize a sealing means (23). These anode and cathode assemblies are alternated and are in contact with and separated by membranes (6). Spacers (40) are utilized as necessary to maintain proper cell dimensions. Finally, grouting material (50) for making the pans more rigid is shown. FIG. 4 is a cross sectional view of one embodiment of integral manifolding showing the position of the integral manifold (100) with relation to membranes (6), spacers (4), cathodes assemblies (5) and anode assemblies (4). Integral manifold (100) is comprised of spacer (101), sealing means (103), manifold sealing means (106) and manifold sections (107). FIG. 5 shows a monopolar cathode assembly (5) in greater detail. Shown are two cathode pans (20), active cathode area (21), sealing means (23), current distributor member (30) and integral manifolds (100). Similarly, FIG. 6 illustrates a monopolar anode assembly (4) comprising two anode pans (10), active anode area (11), sealing means (13), current distributor member (30) and integral manifolds (100). FIG. 7 represents a detailed view of an integral manifolding embodiment showing an anode assembly (4), a cathode assembly (5) and in integral manifold (10). Specifically, the integral manifold (100) is shown as comprising spacer section (101), sealing means (103), coupler (104) and manifold sections (107). Also shown are current distributor member (30) and spacer (40). Obviously, however, the manifold sections (102) and spacer sections (101) of the cathode manifolding are reversed for the anode manifolding.

Figure 8:
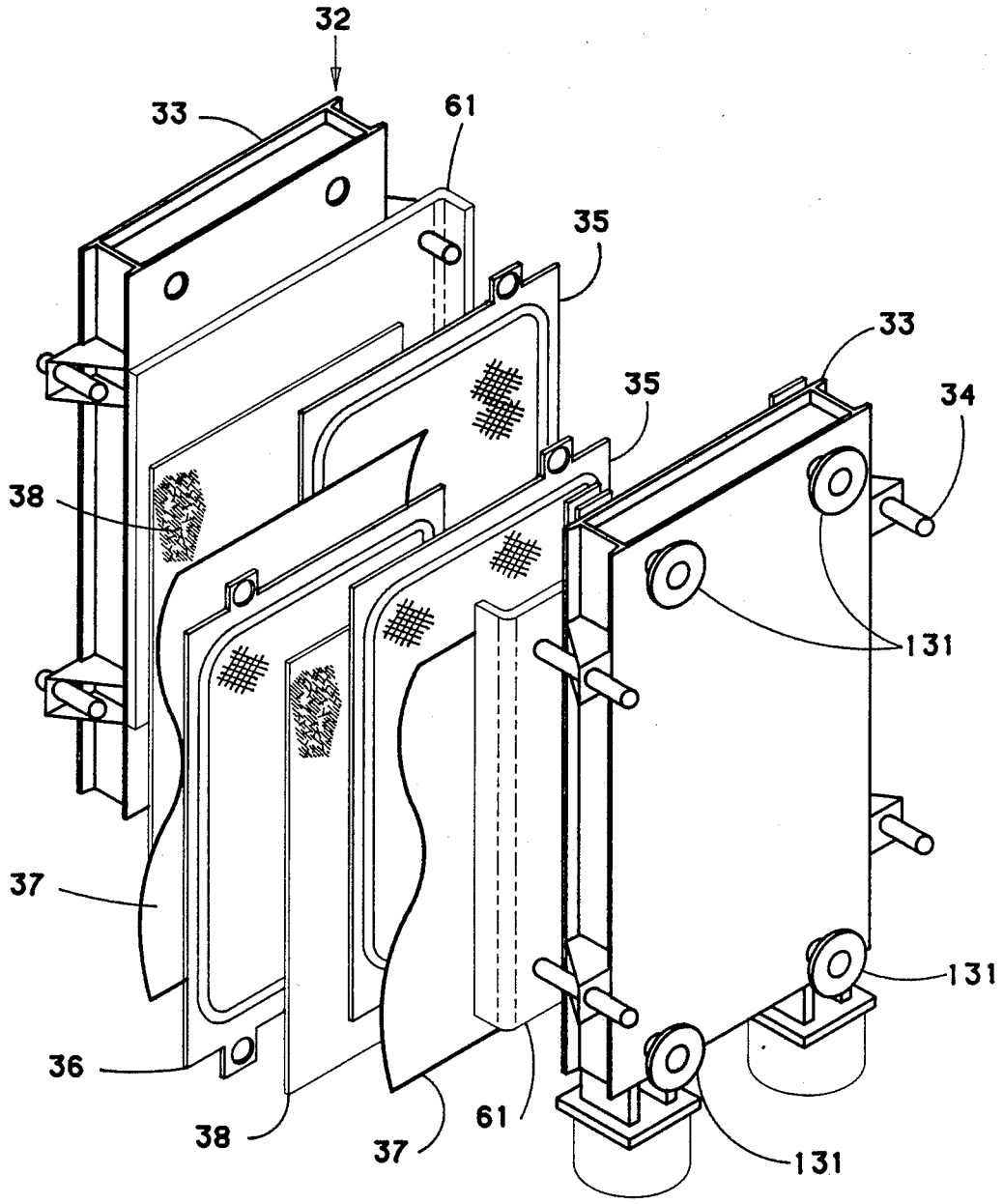
FIG. 8 is an exploded view of a bipolar filter press electrolytic cell of the invention.

FIG. 8 shows a preferred embodiment of a bipolar electrolyzer of the present invention as it relates to cell configuration. FIG. 8 shows a bipolar cell assembly (32) consisting of a plurality of vertically disposed anode pan assemblies (35) and cathode pan assemblies (36) in physical contact with the permselective membranes (37) (zero gap). A single current distributor member (61) is located on each end of the electrolyzer and interface material (38) are located between and in contact with the backs of adjacent anode and cathode pan assemblies. Also shown are integral discharge and inlet ports (131). Additionally bulkheads (33) and tie rods (34) are illustrated.

Figure 9:
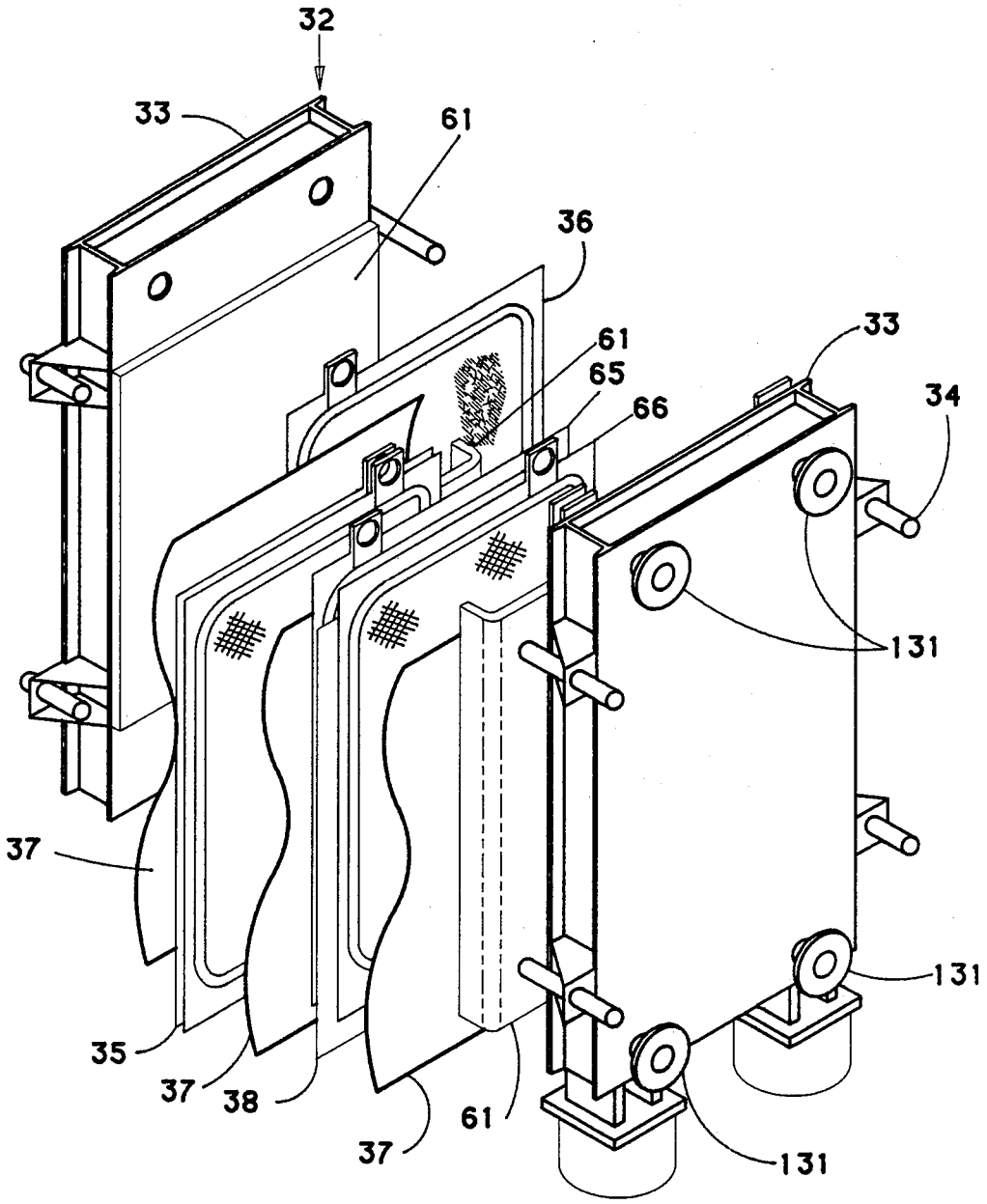
FIG. 9 is an exploded view of one version of a hybrid polarity filter press electrolytic cell of the invention.
Figure 10:
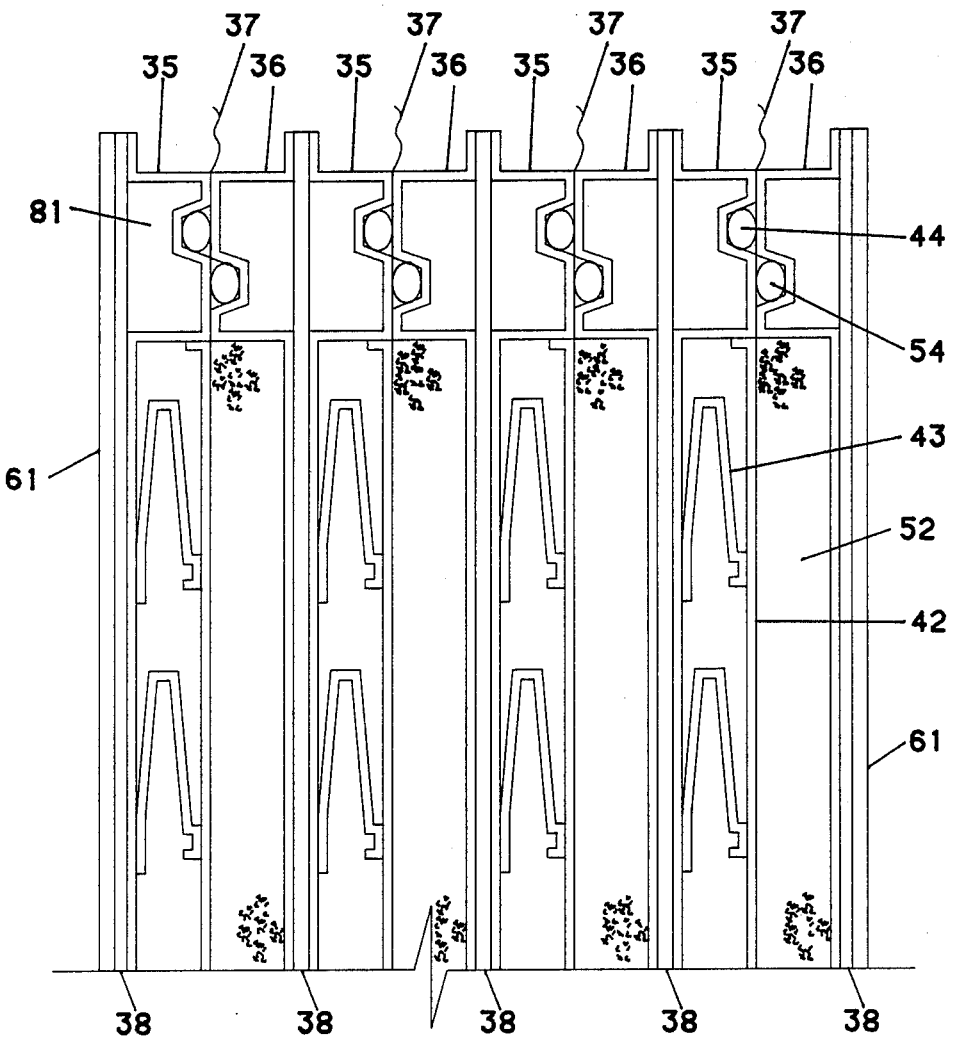
FIG. 10 is an elevation view partial cross section of a bipolar section of a filter press electrolytic cell of the invention.
Figure 11:
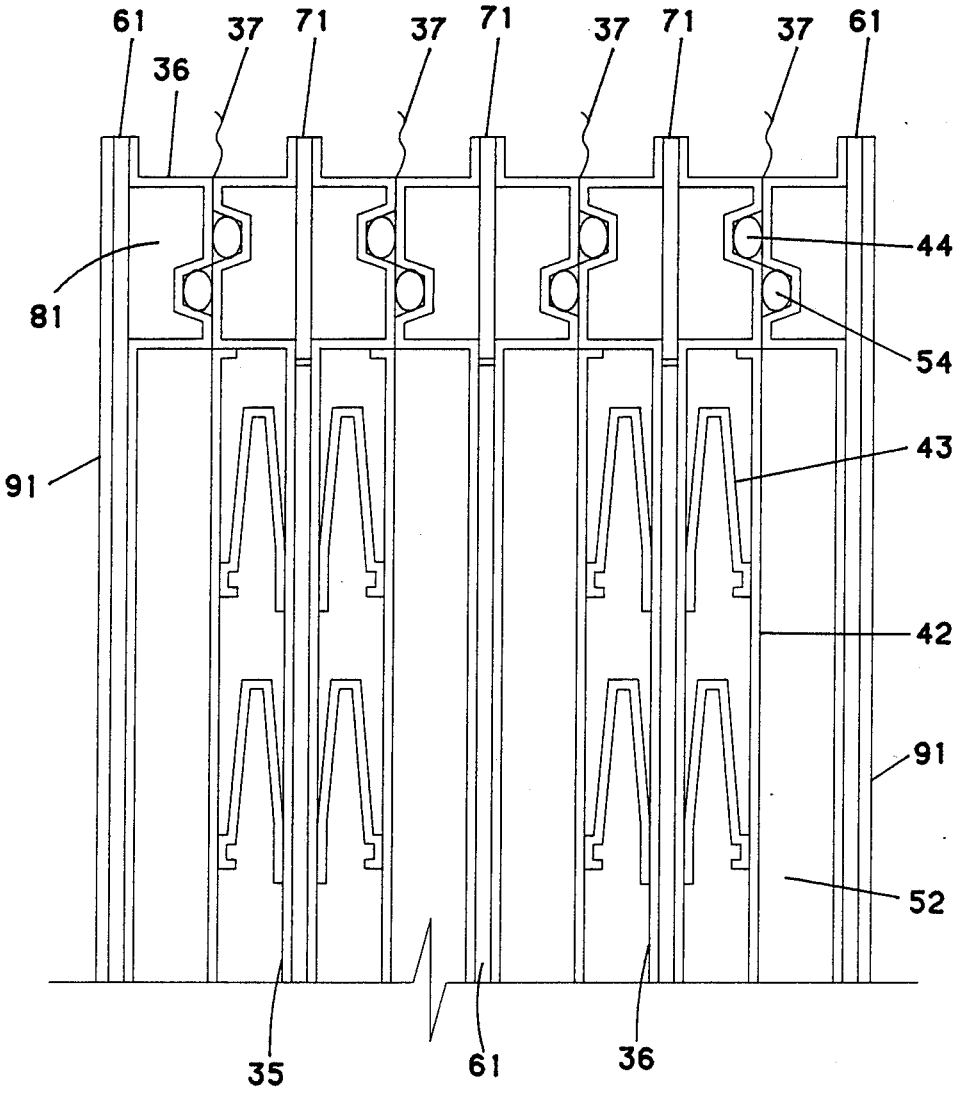
FIG. 11 is an elevation view partial cross section of a monopolar section of a filter press hybrid polarity electrolytic cell of the invention.
Figure 12:
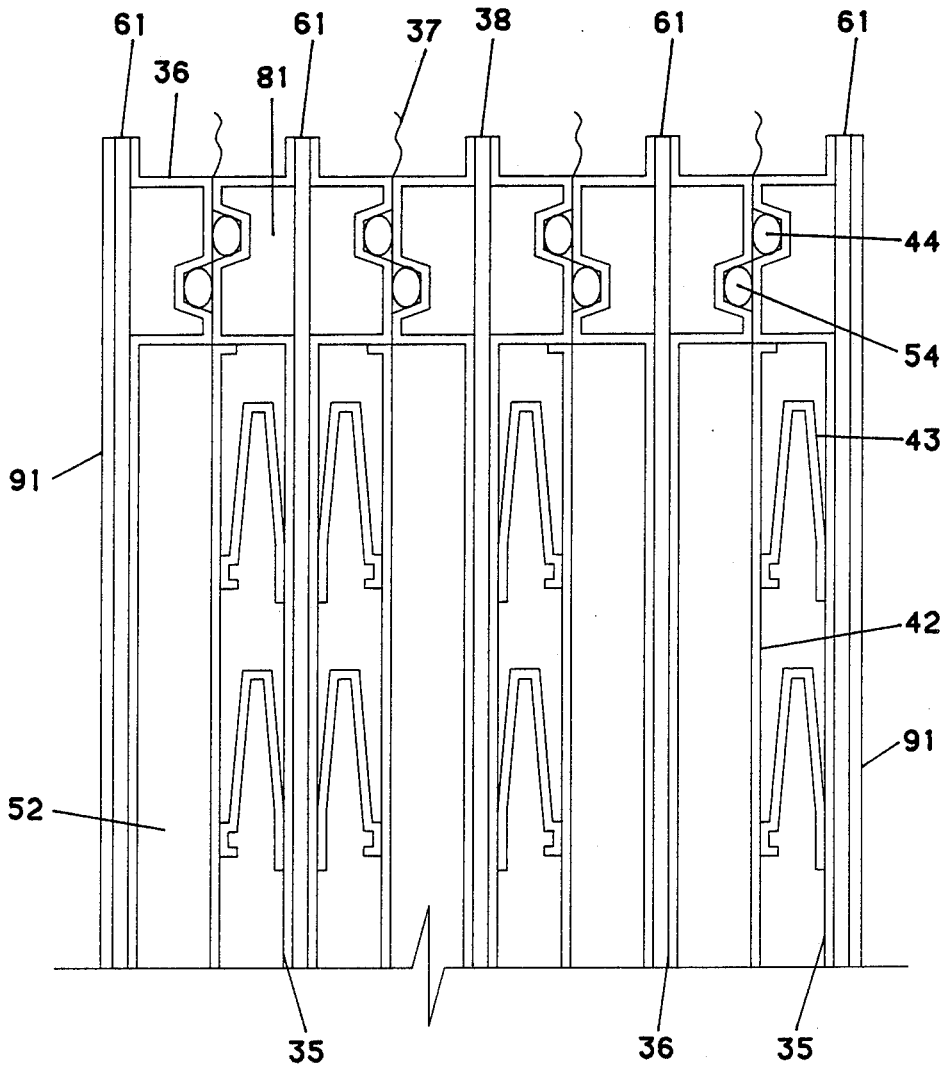
FIG. 12 is a plan view partial cross section of one version of a hybrid polarity section of a filter press electrolytic cell of the invention.
Figure 13:
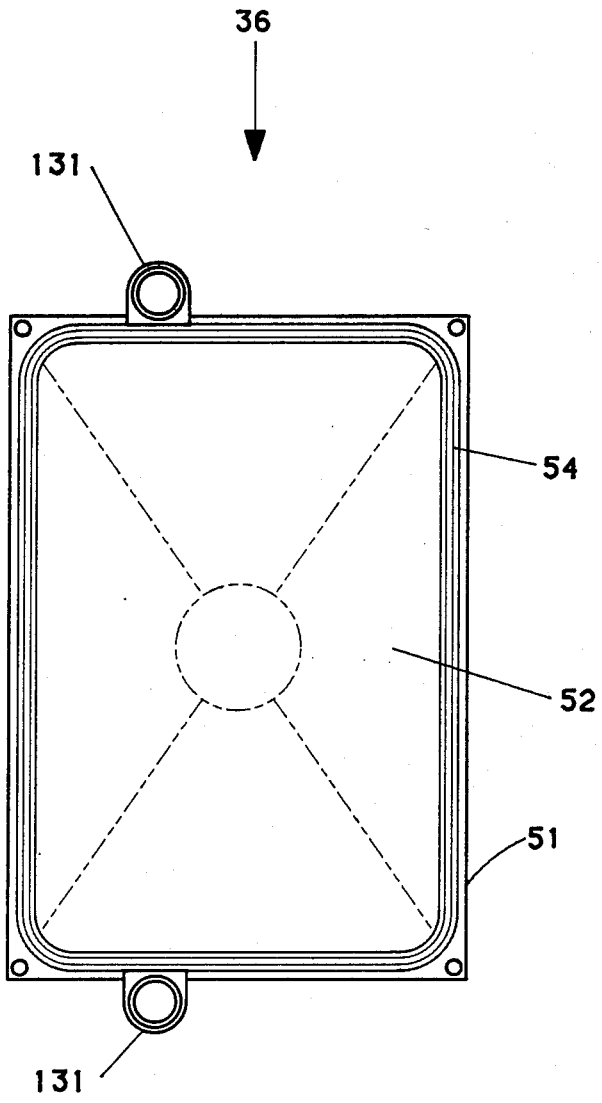
FIG. 13 is a graphic view of a cathode pan.
Figure 14:
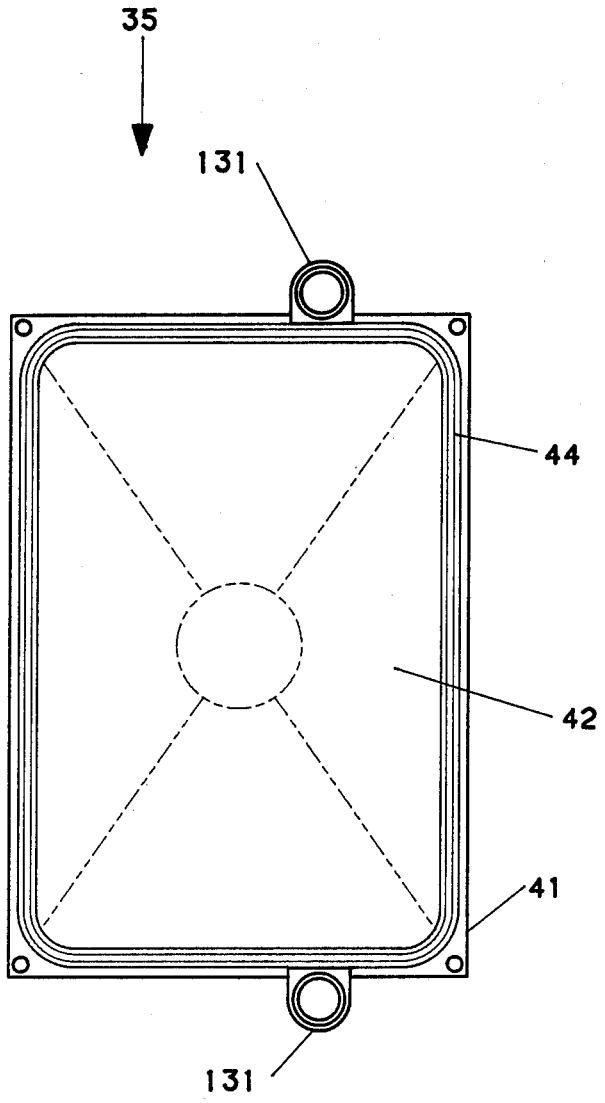
FIG. 14 is a graphic view of an anode pan.

FIG. 9 shows a preferred embodiment of one version of a hybrid polarity electrolyzer of the present invention. As in FIG. 5 the cell (32) comprises bulkheads (33), tie rods (34), anode assemblies (35), cathode assemblies (36), membranes (37), interface material (38), current distributors (61) and integral discharge and inlet ports (131). FIG. 10 shows a partial cross sectional elevation view of FIG. 8. This view shows anode pans (35) and cathode pans (36). Located on either end of the electrolyzer is a single current distributor member (61). The anode pans have active anode areas (42) attached to said pans via springs (43) and also incorporate a sealing means (44). Similarly the cathode pans (36) have active cathode areas (52) attached to them, in this particular case reticulate without springs, and also utilize a sealing means (54). These anode and cathode assemblies are alternated and are in contact with and separated by membranes (37). Interface materials (38) are utilized as necessary to help maintain proper electrical contact. Finally, grouting material (81) for making the pans more rigid is shown. It is understood that as many cells as desired may be placed between the bulkheads, in a variety of monopolar and/or bipolar sections arranged and connected together in an electrolyzer. FIG. 11 shows a partial cross sectional elevation view of a monopolar electrolyzer or a monopolar section of a hybrid polarity electrolyzer. This view shows anode pans (35) located on either side of current distributor member (61). Likewise cathode pans (36) are located on either side of current distributor members (61). The anode pans have active anode areas (42) attached to said pans via springs (43) and also incorporate a sealing means (44). Similarly the cathode pans (36) have active cathode areas (52) attached to them, in this particular case reticulate without springs, and also utilize a sealing means (54). These anode and cathode assemblies are alternated and are in contact with and separated by membranes (37). Spacers (71) are utilized as necessary to maintain proper cell dimensions. Finally, grouting material (81) for making the pans more rigid is shown. Finally, insulators (91) are shown. FIG. 12 shows a partial cross sectional plan view of FIG. 9. This view shows anode pans (35) and cathode pans (36) as well as membranes (37), interface materials (38), current distributor members (61), insulators (91), grouting material (81), cathode active area (52), cathode sealing means (54), anode sealing means (44), anode active area (42) and anode springs (43). FIG. 13 shows a detailed view of a cathode pan assembly (36) with cathode pan (51), cathode active area (52), sealing means (54) and integral discharge and inlet ports (131). FIG. 14 shows a detailed view of an anode pan assembly (35) with anode pan (41), anode active area (42), sealing means (44) and integral discharge and inlet ports (131).

The present invention is further illustrated by the examples which follow without any intention of being limited thereby.

EXAMPLE 1

This example shows how contact resistance and therefore low voltage drop between the current distributor member and the anode as well as between the current distributor and the cathode.

An electrolytic cell having an active surface area of 10 inches (25.4 cm) by 30 inches (76.2 cm) was assembled utilizing a compressible spring loaded titanium DSA$^{RTM}$ anode and a reticulate nickel cathode made following the teaching of U.S. Pat. Application No. 396,747 filed Jul. 9, 1982 now abandoned in favor of U.S. Pat. Application Ser. No. 509,731, issuing as U.S. Pat. No. 4,517,069. The cell also utilized a NAFION$^{RTM}$ membrane separator between the anode and cathode. The cell was run at zero gap. There was a copper reticulate member positioned at the anode back surface and a copper current distribution member positioned against the copper reticulate. There was also a copper current distributor member positioned against the cathode back surface. Electrolube, a conductive grease, was utilized between the anode back and copper current distributor as well as between the cathode back and copper current distributor.

At 2 asi (0.31 amps/cm$^2$), contact resistance betWeen the current distributor member and the anode was approximately 10 mV and approximately 3 mV between the current distributor member and the cathode. These contact resistances were measured using a millivolt meter from the back of the pan to the current distributor member.

EXAMPLE 2

This example shows the usefulness of a reticulate interface material.

The 300 square inch (1935 cm$^2$) monopolar cell was operated with a compressible mesh DSA coated anode and a reticulate cathode fabricated as described in U.S. Application No. 386,934, filed Jun. 10, 1982 now abandoned in favor of U.S. Pat. Application Ser. No. 471,491, issuing as U.S. Pat. No. 4,615,784 in the name of Stewart et al, with a NaCl electrolyte feed. The membrane was a NAFION$^{RTM}$ ion exchange membrane. The cell was run both with and without a copper reticulate material, of substantially the same surface area as the active membrane area, placed between the back of the titanium anode plate and the copper metal current distributer member, also having a surface area substantially the same as the active membrane area. At a current density of 2 asi (0.31 amps/cm$^2$), the contact resistance between the back of the anode plate and the current distributer member was 64 mV without the copper reticulate interface material and 12 mV when the copper reticulate interface material was utilized. The benefit of using this embodiment of the invention to reduce contact resistance is thus, clearly demonstrated.

While the invention has been described in the above-identified examples and by way of the above-identified drawings, other embodiments have been suggested, and deviations and modifications from those embodiments will occur to those skilled in the art upon reading and understanding of the foregoing specification. It is intended that all such embodiments be included within the scope of the invention as defined only by the appended claims.

We claim:

1. A filter press electrolyzer comprising bulkheads, at least one electrolytic cell having an anode electrode assembly and a cathode electrode assembly and an ion-exchange membrane resiliently engaged therebetween, said electrode assemblies having electrode active areas and back plates of electrically conductive material forming at least a portion of an electrolyte compartment, said cell including sealing means and means for introducing and removing fluids and electrical energy, wherein (a) said back plates of the electrode assemblies are formed of electrically conductive material, (b) said electrical energy is passed between two adjacent back plates of adjacent cells and between the back plate of an end cell and a bulkhead via current distributor members through mechanical contact joints involving only low pressure connection, said contact joints being at least substantially as large as the dimensions of the electrode active areas, and being separated from cell electrolyte by the back plates and being located outside the adjacent cells, and (c) at least some of said electrode assemblies include spring compression members extending between said back plates and the active electrode areas, and wherein (d) said current distributor members protrude past the side of adjacent cells on at least one side and provide structural support for said cells.

2. The electrolyzer according to claim 1, wherein said electrode assemblies are formed integrally with pans of electrically conductive material and each of said pans incorporates peripheral sealing means, as well as incorporating integral electrically conductive manifolds as means for introducing and removing fluids.

3. The electrolyzer according to claim 2, wherein said electrode assembly pan includes a portion rigidified by grouting or a filler material or both.

4. The electrolyzer according to claim 2, wherein said integral manifolds contain a spacer, a sealing means, manifold sealing means and manifold sections.

5. The electrolyzer according to claim 1, wherein the electrical contact joint connects a cathode back plate with an anode back plate.

6. The electrolyzer according to claim 1, wherein said low pressure connection of the mechanical contact joints of adjacent cells is held at pressure between 0.035 and 7.03 kg/cm$^2$.

7. The electrolyzer according to claim 1, wherein said current distributor members conduct current to or from the electrodes from a source exterior to said electrolyzer or from another section of the electrolyzer through an external path.

8. The electrolyzer according to claim 7, wherein it comprises at least one monopolar electrolytic cell.

9. The electrolyzer according to claim 7, wherein it comprises at least two bipolar filter press electrolytic cells in which a current distributor member is between the back plates of anode and cathode assemblies of adjacent bipolar cells.

10. The electrolyzer according to claim 1, wherein the current distributor members are in the form of a solid planar metal sheets made from nickel, iron, steel, aluminum, copper or alloys thereof.

11. The electrolyzer according to claim 1, wherein said current distributor members are solid planar metal sheets having a coating of conductive material on sides which are in contact with said back plates.

12. The electrolyzer according to claim 1, wherein said current distributor members are metal clad planar sheets.

13. The electrolyzer according to claim 1, wherein said current distributor members are solid planar metal sheets comprising an interface material selected from conductive reticulated material, sponge metal, conductive wools, conductive metal sheets and combinations thereof in contact with said solid planar metal sheets and said back plates.

14. The electrolyzer according to claim 1, wherein said electrode assemblies including spring compression members are anode assemblies comprising a metal back plate and a valve metal electrode substrate having an electrocatalytic coating thereon.

15. The electrolyzer according to claim 1, wherein said electrode assemblies including spring compression members are cathode assemblies comprising a back plate and a cathode surface made of nickel, a ferrous metal, or an alloy of nickel or ferrous metal.

16. The electrolyzer according to claim 1, wherein it comprises, in combination, monopolar and bipolar cells arranged between said bulkheads.

* * * * *